United States Patent [19]

Tischer et al.

[11] Patent Number: 4,794,306

[45] Date of Patent: Dec. 27, 1988

[54] FLAT PICTURE-REPRODUCING DEVICE

[75] Inventors: Kurt-Manfred Tischer, Wendlingen; Harald Rose, Darmstadt; Rainer Spehr, Ober-Ramstadt; Gerald Schonecker, Russelsheim, all of Fed. Rep. of Germany

[73] Assignee: Standard Elektrik Lorenz AG, Stuttgart, Fed. Rep. of Germany

[21] Appl. No.: 933,405

[22] Filed: Nov. 20, 1986

[30] Foreign Application Priority Data

Nov. 21, 1985 [DE] Fed. Rep. of Germany ..... 3541164

[51] Int. Cl.[4] ..... G09G 3/10

[52] U.S. Cl. ..... 315/169.3; 315/107; 315/169.4; 313/302; 313/422

[58] Field of Search ..... 313/422, 302, 306, 309; 315/94, 106, 107, 169.3

[56] References Cited

U.S. PATENT DOCUMENTS

| | | | |
|---|---|---|---|
| 4,121,130 | 10/1978 | Gang | 313/302 |
| 4,167,690 | 9/1979 | Gange | 313/422 |
| 4,227,117 | 10/1980 | Watanabe et al. | 313/422 |
| 4,451,852 | 5/1984 | Masuda et al. | 313/422 |
| 4,651,058 | 3/1987 | Hamada et al. | 315/107 |
| 4,658,188 | 4/1987 | Bohmer | 313/422 |

*Primary Examiner*—David K. Moore
*Assistant Examiner*—Michael Razavi
*Attorney, Agent, or Firm*—Christie, Parker & Hale

[57] ABSTRACT

In a flat picture-reproducing device having a phosphor-coated faceplate (1) and a tray-shaped rear housing (2), a cathode formed by a periodic array of heating wires (7) is provided. This heating-wire array is followed by layers of focusing wires (8) and attracting wires (9) and by a perforated anode (5). A segmented counterelectrode (6) is located behind the heating wires (7).

10 Claims, 1 Drawing Sheet

FLAT PICTURE-REPRODUCING DEVICE

BACKGROUND OF THE INVENTION

1. Field of the Invention

The invention relates to a flat picture-reproducing device.

2. Description of the Prior Art

The article entitled "Der flache Fernsehbildschirm" published in Vol. 10 (1980) of the "Funkschau" journal, pp. 63 to 66, FIG. 2, describes such a flat picture-reproducing device. It has a glass faceplate whose inside is coated with phosphor, a digitally addressed control arrangement ("switching stack") for shaping and modulating the stream of electrons, an area cathode which emits a uniform stream of electrons in the direction of the control arrangement, and a metal-shell vacuum enclosure at the rear. The cathode is formed by a periodic array of oxide-coated heating wire. The metal-shell vacuum enclosure serves as a counterelectrode, and a periodic array of field-shaping electrodes is located in a layer between this counterelectrode and the heating wires.

This area cathode requires a large quantity of heat because the cathode has to perform the maximum current density for the peak brightness at any moment, although only a fraction of the current density is needed most of the time. This static operating mode damages the oxide-coated heating wires and shortens their useful life.

SUMMARY OF THE PRESENT INVENTION

It is an object of the present invention to provide a flat picture-reproducing device which requires a reduced quantity of heat and which produces a uniform, high brightness of the phosphor coating.

IN THE DRAWING

DETAILED DESCRIPTION OF THE PREFERRED EMBODIMENT

Figure 1:
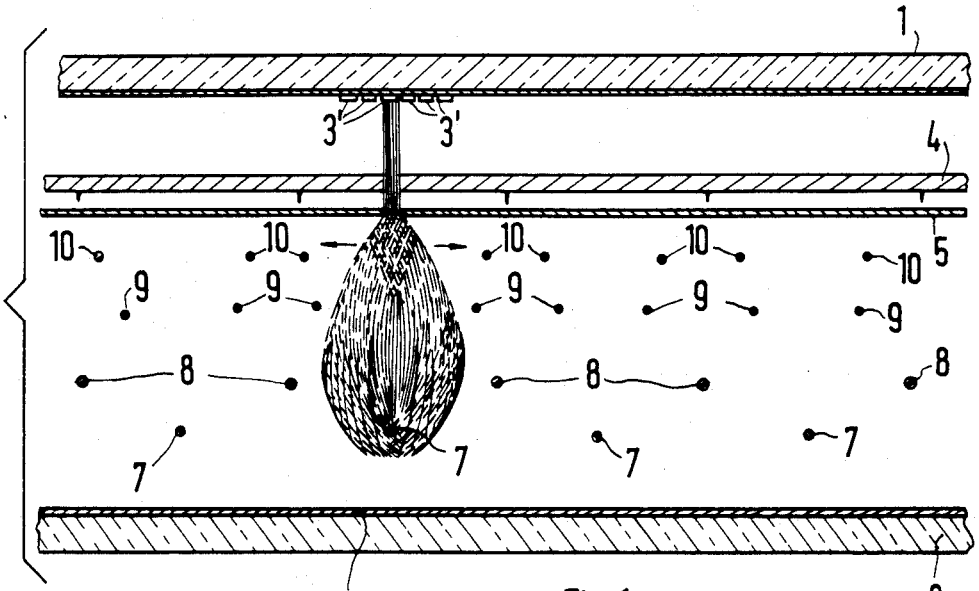
FIG. 1 is a vertical section of the flat picture-reproducing device.

FIG. 1 shows only a portion of the flat picture-reproducing device in a vertical section. Together with its tray-shaped rear housing 2, the faceplate 1 forms a vacuum enclosure. The inside of the faceplate has a phosphor coating, of which only six picture elements 3 are shown. Spaced apart from the faceplate 1, a control arrangement 4 is located which will not be described here in any detail. It is followed by an anode 5 which is perforated in a pattern corresponding to the picture elements on the faceplate 1. A segmented counterelectrode 6 is deposited at the inside of the tray-shaped rear housing 2. The segments of the counterelectrode 6 are arranged perpendicular to the longitudinal dimension (axes) of the heating wires 7 and their number is proportional to the number of the picture elements 3 in one line. The counterelectrode is preceded by a periodic array of oxide-coated heating wires 7. The heating wires 7 are all in one two dimensional array (layer) parallel to the counterelectrode 6. The longitudinal dimension of the heating wires 7 runs vertical to the plane of the paper. In further layers between the heating wires 7 and the anode 5, there are focusing wires 8, attracting wires 9, and shaping wires 10. All heating wires 7, focusing wires 8, attracting wires 9, and shaping wires 10 have longitudinal axes which are parallel to each other.

With the assembly shown in FIG. 1, an area cathode for a flat picture-reproducing device can be simulated. For that purpose, it is assumed that the segmented counterelectrode 6 and the heating wire 7 are at a potential of 0 V. To that end, the heating wires 7 are energized during the horizontal retrace period only and then emit electrons during the trace period. Alternatively, the heating wires can be energized only during the vertical retrace period. A positive voltage in the range of 150 to 500 V is applied to the attracting wires 9. The electrons are thus accelerated in the direction of the attracting wires 9. A positive voltage in the range of 5 to 40 V is applied to the following anode 5 so that a predetermined retarding field is built up and the electrons, when passing through the holes of the anode 5, have only a small speed. A negative voltage with an absolute value of about one third of the voltage applied to the attracting wires 9 is applid to the focusing wires 8. As shown in FIG. 1 at the second heating wire from the left, the cloud of electrons emitted by the heating wires 7 is thus formed. This leaf-shaped electron beam passes through the holes arranged in lines in the anode 5 and through the control arrangement 4, and then strikes the picture elements 3 arranged in one line. The brightness modulation of the individual picture elements in this line will be explained later with the help of FIG. 2. For better shaping the cloud of electron, a voltage is applied to the shaping wires 10 which is negative with respect to the voltage at the attracting wires 9 and which can be, e.g., −40 V.

In addition to the negative voltage at the focusing wires 8, the latter and/or the shaping wires 10 are subjected to reflecting voltages which change in such a manner that the leaf-shaped electron beam of each heating wire 7 strikes successive lines subsequently. It is thus possible to withdraw electrons from only one heating wire at a time and to block the emission of electrons from the other heating wires. This is achieved by supplying the positive voltage only to the attracting wires associated with the respective heating wire, while the other attracting wires are at zero potential. As soon as the last line in the range of the respective heating wire 7 is reached, a changeover is effected at the next heating wire 7. The deflecting voltage at the focusing wires 8 is then changed in such a way that the leaf-shaped electron beam now formed strikes the first line for this heating wire 7. The electron beam is switched on from line to line as described above. By withdrawing electrons from only one heating wire 7 at a time, the power dissipation is much reduced. By the pulse-shaped energization of the heating wire energized at the time, zero potential of the heating wires is achieved during picture reproduction.

Figure 2:
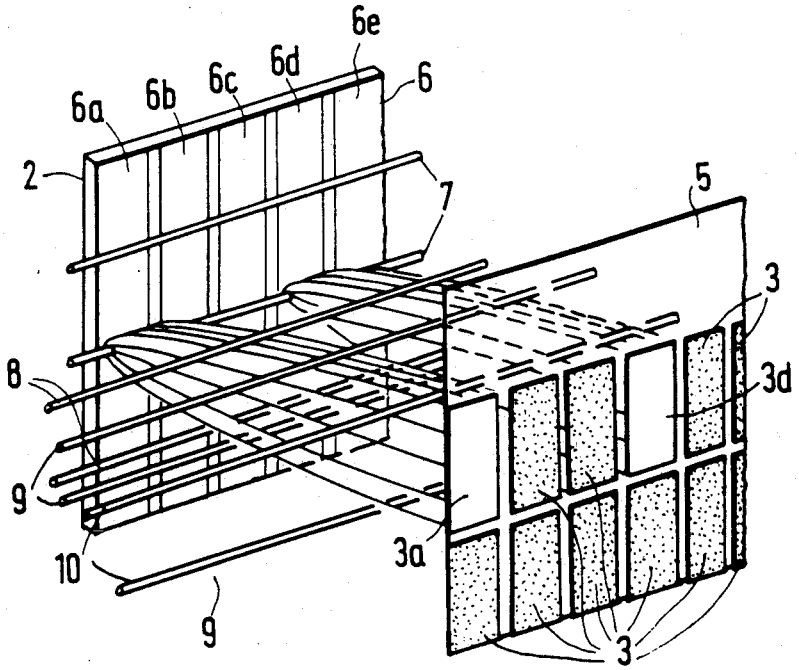
FIG. 2 is a perspective view of part of the flat picture-reproducing device.

FIG. 2 is a perspective view of the cathod structure described in FIG. 1. Like parts are indicated by like reference numerals. In this figure, the individual segments *6a*, *6b*, *6c*, *6d* and *6e* of the counterelectrode 6 can be clearly seen. The lower of the two heating wires 7 is activated and therefore emits electrons which fly to the perforated anode 5. Only two lines with holes 3 are shown in the anode 5. In the embodiment shown in FIG. 2, the electrons emitted by the heating wire 7 fly through the holes of the upper line only. Therefore, all holes in the lower line are dotted. A potential of 0 V is applied to the segments 6a and 6d of the counterelectrode. A voltage of −10 V has been applied to the segments 6b, 6c and 6e. As a result, no electrons are emitted in the ranges of the heating wire 7 opposite these segments. Electrons can only be emitted from the ranges of the heating wire 7 opposite the segments 6a and 6d and fly through the corresponding holes 3a, 3d in the anode 5. These holes 3a and 3d are white in FIG. 2, while the other holes 3 in the same line are dotted because no electrons pass through them. As the electrons pass through the selected holes in the respective line in the anode 5, the picture elements on the corresponding faceplate emit light.

If values between 0 V and −50 V are chosen for the voltage at the segments of the counterelectrode 6, the brightness of the picture elements can thus be controlled. Because such brightness control fo the picture elements has a direct effect on the emission of the heating wires, the result is a dynamic operation of the emission of the heating wires. As compared to the static operation with constant maximum emission as known from the state of the art, the dynamic operation is a state which is tailored to the oxide-coated heating wires and in which they enjoy a long life.

The space between the heating wires 7 and the counterelectrode 6 should be chosen as large as possible so that a change of position of the heating wires has a minimum impact. The larger the space, the larger the absolute value of the negative voltage at the counterelectrode will have to be.

What is claimed is:

1. In a flat, vacuum-enclosed picture-reproducing display device having a phosphor-coated glass faceplate and a shallow tray-shaped rear housing containing an area cathode consisting of a first two-dimensional array of heating wires for emitting a beam of electrons, a counterelectrode behind said first array, and a control arrangement between said cathode and said faceplate:

a second two-dimensional array of conductive focusing electrode elements each above and to one side of at least one associated said heating wire, means for applying to at least those of said focusing electrode elements associated with a selected said heating wire a negative potential with respect thereto for repelling the laterally extending portion of said beam of electrons emanating from the selected heating wire, thereby focusing said beam of electrons;

a third two-dimensional array of conductive attracting electrode elements each above an associated one of said focusing electrode elements and laterally displaced with respect thereto towards an associated one of said heating wires, means for applying to at least those of said focusing electrode elements associated with a selected said heating wire a first positive potential with respect thereto for attracting said beam of electrons emanating from the selected heating wire, thereby accelerating said beam of electrons;

a perforated anode, and means for applying to said anode a second positive potential below than said first positive potential thereby decelerating said beam of electrons before it reaches said anode, a fourth two-dimensional array of shaping electrode elements each above an associated one of said attracting electrode elements and laterally located between an associated one of said heating wires and an associated one of said focusing electrode elements for shaping said beam of electrons, means for applying to at least those of said shaping electrode elements associated with a selected said heating wire a second negative potential with respect thereto for repelling any laterally extending portion of said beam of electrons in the vicinity of said associated shaping electrode elements thereby shaping said beam of electrons;

means for applying to said anode a second positive potential below than said first positive potential thereby decelerating said beam of electrons before it reaches said anode, said second two-dimensional array, said third two-dimensional array, said fourth two-dimensional array and said perforated anode being arranged successively between said first two-dimensional array and said control arrangement, whereby said beam of electrons is accelerated, formed, focused, shaped and decelerated before it reaches said control arrangement.

2. A flat picture-reproducing device as claimed in claim 1, further comprising a fourth two-dimensional array of wires for shaping said beam of electrons; said fourth two-dimensional array being located between third two-dimensional array and said perforated anode.

3. A flat picture-reproducing display device as claimed in claim 1, characterized in that said heating, focusing, attracting, and shaping electrode elements are each wires oriented along parallel longitudinal axes.

4. A flat picture-reproducing display device as claimed in claim 3, wherein said counterelectrode has segments arranged perpendicular to said longitudinal axes.

5. A flat picture-reproducing display device as claimed in claim 1, wherein said heating wires are at zero potential, a positive voltage of between 150 and 500 V is applied to said attracting electrode elements, a positive voltage of between 5 and 40 V is applied to said the anode, a negative voltage with an absolute value of about one third of the voltage of said attracting electrode elements is applied to said focusing electrode elements.

6. A flat picture-reproducing display device as claimed in claim 5, wherein deflecting voltages are superimposed on said negative voltage at said focusing electrode elements.

7. A flat picture-reproducing display device as claimed in claim 1, wherein a voltage is applied to said shaping electrode elements which is negative with respect to the voltage at said attracting electrode elements.

8. A flat picture-reproducing display device as claimed in claim 7, wherein deflecting voltages are superimposed on said negative voltage at said shaping electrode elements.

9. A flat picture-reproducing display device as claimed in claim 8, wherein current is taken from only one of said heating wires in such a manner that only the two adjacent ones of said attracting electrode elements are energized.

10. A flat picture-reproducing display device as claimed in claim 9, characterized in that said heating wires are energized only on a periodic basis.

* * * * *

UNITED STATES PATENT AND TRADEMARK OFFICE

CERTIFICATE OF CORRECTION

PATENT NO. : 4,794,306

DATED : December 27, 1988

INVENTOR(S) : K.M. Tischer; H. Rose; R. Spehr; G. Schonecker

It is certified that error appears in the above-identified patent and that said Letters Patent is hereby corrected as shown below:

In the Specification:

Column 1, line 19, change "wire" to -- wires --.
Column 1, line 38, change "DRAWING" to -- DRAWINGS --.
Column 1, line 50, change "3" to -- 3' --.
Column 1, line 54, after "pattern" insert -- (holes 3 of Fig. 2) --.
Column 1, line 55, after "elements" insert -- 3' --.
Column 1, line 60, change "3" to -- 3' --.

Column 2, line 21, change "applid" to -- applied --.
Column 2, line 25, after "holes" insert -- 3 (FIG. 2) --.
Column 2, line 27, change "3" to -- 3' --.
Column 2, line 29, after "elements" insert -- 3' --.
Column 2, line 58, after "perspective" insert -- part --.
Column 2, line 58, change "cathod" to -- cathode --.

Column 3, line 12, after "elements" insert -- 3' --.
Column 3, line 17, change "fo" to -- of --.

UNITED STATES PATENT AND TRADEMARK OFFICE

CERTIFICATE OF CORRECTION

PATENT NO. : 4,794,306

DATED : December 27, 1988

INVENTOR(S) : K.M. Tischer; H. Rose; R. Spehr; G. Schonecker

It is certified that error appears in the above-identified patent and that said Letters Patent is hereby corrected as shown below:

In the Claims

Column 3, line 62, after "below" delete "than".
Column 4, line 13, after "below" delete "than".
Column 4, lines 23-27, delete Claim 2

Column 4, lines 40,41, change "to said the anode" to -- to said anode --.

Signed and Sealed this

Twenty-fourth Day of October, 1989

*Attest:*

*Attesting Officer*

DONALD J. QUIGG

*Commissioner of Patents and Trademarks*